US005839939A

United States Patent [19]

Ohi

[11] Patent Number: 5,839,939

[45] Date of Patent: Nov. 24, 1998

[54] MOVING TOY THAT PROTRUDES FROM AND RETREATS INTO A BODY

[75] Inventor: Ichiro Ohi, Tokyo, Japan

[73] Assignee: Tomy Company, Ltd.

[21] Appl. No.: 871,882

[22] Filed: Jun. 9, 1997

[30] Foreign Application Priority Data

Aug. 9, 1996 [JP] Japan ..... 8-007981 U

[51] Int. Cl.[6] ..... A63H 30/00; A63H 11/06; A63H 3/36

[52] U.S. Cl. ..... 446/175; 446/311; 446/320

[58] Field of Search ..... 446/175, 297, 446/298, 299, 302, 303, 308, 309, 310, 311, 320, 397, 486, 487

[56] References Cited

U.S. PATENT DOCUMENTS

| | | | |
|---|---|---|---|
| 2,113,750 | 4/1938 | Travis | 446/459 X |
| 2,646,646 | 7/1953 | Glass | 446/310 |
| 4,626,224 | 12/1986 | Benson et al. | 446/308 X |
| 5,087,219 | 2/1992 | Price | 446/336 |
| 5,145,447 | 9/1992 | Goldfarb | 446/397 X |
| 5,259,807 | 11/1993 | Crow | 446/397 |
| 5,391,106 | 2/1995 | Lidert, Jr. | 446/320 X |
| 5,458,525 | 10/1995 | Hw | 446/310 |
| 5,584,741 | 12/1996 | Cheung | 446/309 X |

FOREIGN PATENT DOCUMENTS

| | | | |
|---|---|---|---|
| 1100820 | 9/1955 | France | 446/310 |

*Primary Examiner*—Robert A. Hafer
*Assistant Examiner*—D Neal Muir
*Attorney, Agent, or Firm*—Nixon & Vanderhye P.C.

[57] ABSTRACT

A moving toy having a structure in which a movable member with a shape can protrude from and retreat into an inside of a body has a motor, a rotary member which is rotated by the motor, a plate-shaped elastic member which has an end connected to the rotary member at an eccentric position thereof and the other end connected to the movable member, to make the movable member protrude from or retreat into the inside of the body by converting a rotational movement of the rotary member into a linear movement, and a control member for controlling the motor.

15 Claims, 5 Drawing Sheets

MOVING TOY THAT PROTRUDES FROM AND RETREATS INTO A BODY

BACKGROUND OF THE INVENTION

1. Field of the Invention

The present invention relates to a moving toy having a structure in which a movable member with a shape such as an animal or the like can protrude from and retreat into an inside of a body.

2. Description of Related Art

As an example of such a moving toy in which a movable member can protrude from and retreat into the inside of the body, a whack-a-mole game apparatus has been known. The whack-a-mole game apparatus has a structure in which mole dolls can be protruded from or retreated into the inside of the body such as a table or the like, using a cam mechanism or a linkage.

However, in such a conventional moving toy in which a movable member such as a mole doll or the like is protruded from or retreated into the inside of the body by using a cam mechanism or a linkage, movements are awkward and therefore cannot give a soft and smooth action similar to that of a real animal to the movable member.

Further, there is another problem in that such a conventional moving toy results in a higher production cost because of a large number of parts and a complicated structure.

SUMMARY OF THE INVENTION

The present invention was developed in view of the above-described problems. An object of the present invention is to provide a moving toy in which a movable member can protrude from or retreat into the inside of the body, and can give a soft and smooth action similar to that of a real animal at a lower production cost.

In accordance with one aspect of the present invention, a moving toy is provided having a structure in which a movable member with a shape can protrude from and retreat into an inside of a body. The moving toy includes the body having an opening, the movable member with the shape for protruding from or retreating into the inside of the body through the opening, a motor, a rotary member which is rotated by the motor, a plate-shaped elastic member which has an end connected to the rotary member at an eccentric position thereof and the other end connected to the movable member, to make the movable member protrude from or retreat into the inside of the body by converting a rotational movement of the rotary member into a linear movement, and a control member for controlling the motor.

According to the moving toy having such a structure, it is possible to give a soft and smooth action to the movable member because the movable member is supported and operated by the plate-shaped elastic member, which smoothly converts a rotational movement of the rotary member into a linear movement.

Preferably, the elastic member has a band shape. The movable member may have a shape of an animal doll. Accordingly, it is possible to give a soft and smooth action similar to that of a real animal to the movable member.

Preferably, the moving toy further includes a sound generating member for generating a sound like a cry of the animal. According to the moving toy having such a structure, it is possible to provide a moving toy which gives a person added enjoyment because of the beauty and realism of the sound like a cry of the animal.

The moving toy may further include a sound sensing member for sensing an external sound and for supplying a signal on the basis of the sensed external sound to the control member so as to rotate the motor. According to the moving toy having such a structure, it is possible to provide a very interesting moving toy which can exhibit the behavior of a real animal sensitive to an external sound because the movable member of an animal doll is operated in response to the external sound.

Preferably, the moving toy further includes a sound sensing member for sensing an external sound and for supplying a signal on the basis of the sensed external sound to the control member so as to rotate the motor and to operate the sound generating member.

The elastic member is preferably bent in a smooth L-shape along the longitudinal direction, which comprises a horizontal portion connected to the rotary member and a vertical portion connected to the movable member. Preferably, the elastic member is bent in a bow shape along the width direction. The elastic member may be a leaf spring made of steel or stainless steel.

Because the band-shaped elastic member which is bent in a bow shape along the width direction, in particular, of a leaf spring made of steel or stainless steel, is hard to be folded and is apt to turn back to the bent state in a bow shape along the width direction soon after it is bent in the longitudinal direction, it is possible to give a soft and smooth action to the movable member.

Preferably, the movable member is controlled by the control member so that a movement thereof for protruding from or retreating into the inside of the body is irregular. Accordingly, it is possible to provide a further interesting moving toy which has the movable member moving irregularly. When the movable member is an animal doll, it is possible to provide a moving toy having a movable member which can move like a real animal.

The amount of protrusion of the movable member from the inside of the body or the amount of retreat thereof, may be controlled to be irregular. Preferably, the control member has a mode changing switch for selecting from one of an automatic mode in which the movable member is controlled to protrude from or to retreat into the inside of the body irregularly, an off mode in which the movable member is not operated, and a sound sensing mode in which the movable member is operated only when an external sound is sensed. The movable member may not only protrude from or retreat into the inside of the body but may also change the direction thereof simultaneously.

Preferably, rotation of the motor is transferred to the rotary member through a rubber band which can slip to the rotary member when a large force is applied to the rotary member in the reverse direction. According to the moving toy having such a structure, it is possible to prevent damage of the motor by making the rubber band slip to the rotary member when the movement of the movable member is stopped by force during operation of the motor, and to make the construction at a lower cost.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

Hereinafter, an embodiment of the moving toy according to the present invention will be explained with reference to the drawings, as follows.

Figure 1A:
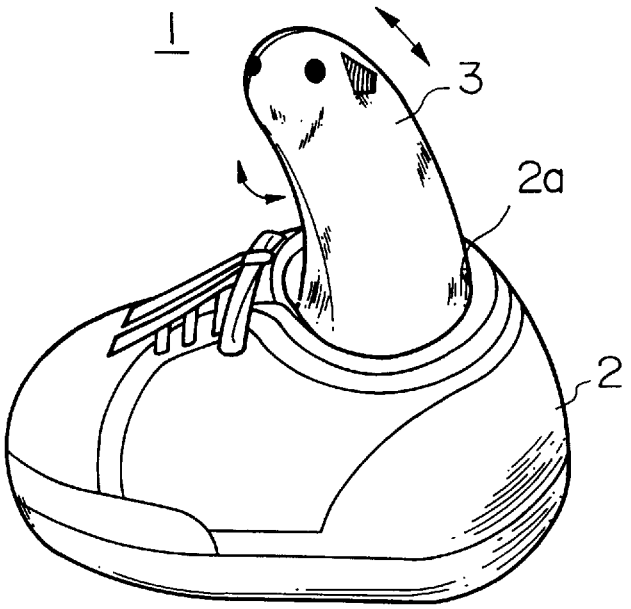
FIG. 1A is a perspective view of a moving toy in a state of the animal doll protruding from the inside of the body, according to an embodiment of the present invention.
Figure 1B:
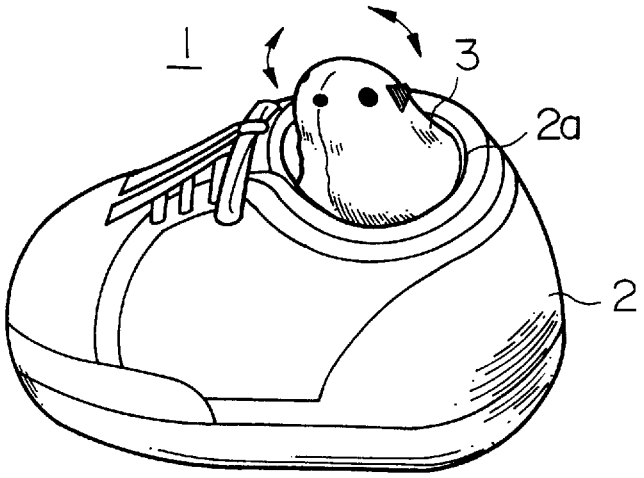
FIG. 1B is a perspective view of the moving toy in a state of the animal doll retreating into the inside of the body, according to the embodiment of the present invention.

FIGS. 1A and 1B show the states of the animal doll 3 protruding from and retreating into the inside of the body, in the moving toy 1 according to an embodiment of the present invention. In the embodiment, the body 2 of the moving toy 1 is made in the form of a shoe having an opening 2*a*. In the opening 2*a*, an animal doll 3 which was modeled on a prairie dog is provided. The animal doll 3 is provided so that it can be protruded from and retreated into the inside of the body 2.

Figure 4:
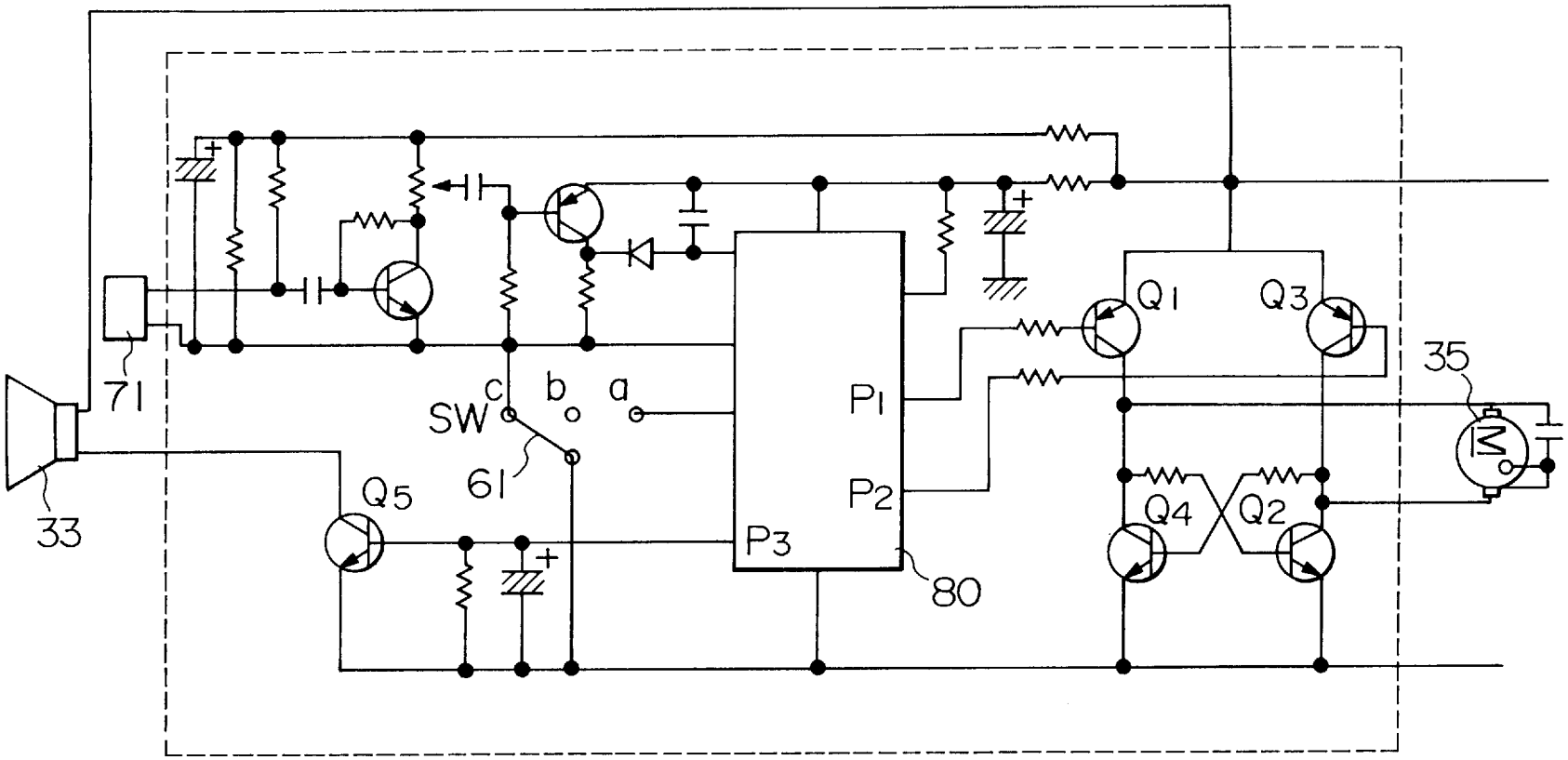
FIG. 4 is a circuit diagram showing a control circuit in the embodiment.

In the moving toy 1, in the event that a mode changing switch SW is handled to select an automatic mode, as shown in FIG. 4, the moving toy 1 is operated so that the animal doll 3 is irregularly protruded from or retracted into the inside of the body 2. In this case, the amount of protrusion of the animal doll 3 from the inside of the body 2 is not constant, that is, the animal doll 3 is largely partially protruded at a time, and is partially at another time, from the inside of the body 2. The face of the animal doll 3 is also turned laterally a little. When the animal doll 3 is protruded from or retracted into the inside of the body 2, a sound similar to whining of a prairie dog is produced from the body 2.

In the event that the mode changing switch SW is handled to select a sound sensing mode, the moving toy 1 is operated so that the animal doll 3 is protruded from or retracted into the inside of the body 2 when an external sound is sensed. Like the automatic mode, when the animal doll 3 is protruded from or retracted into the inside of the body 2 by sensing external sound, a sound similar to whining of a prairie dog is also produced from the body 2.

Figure 2:
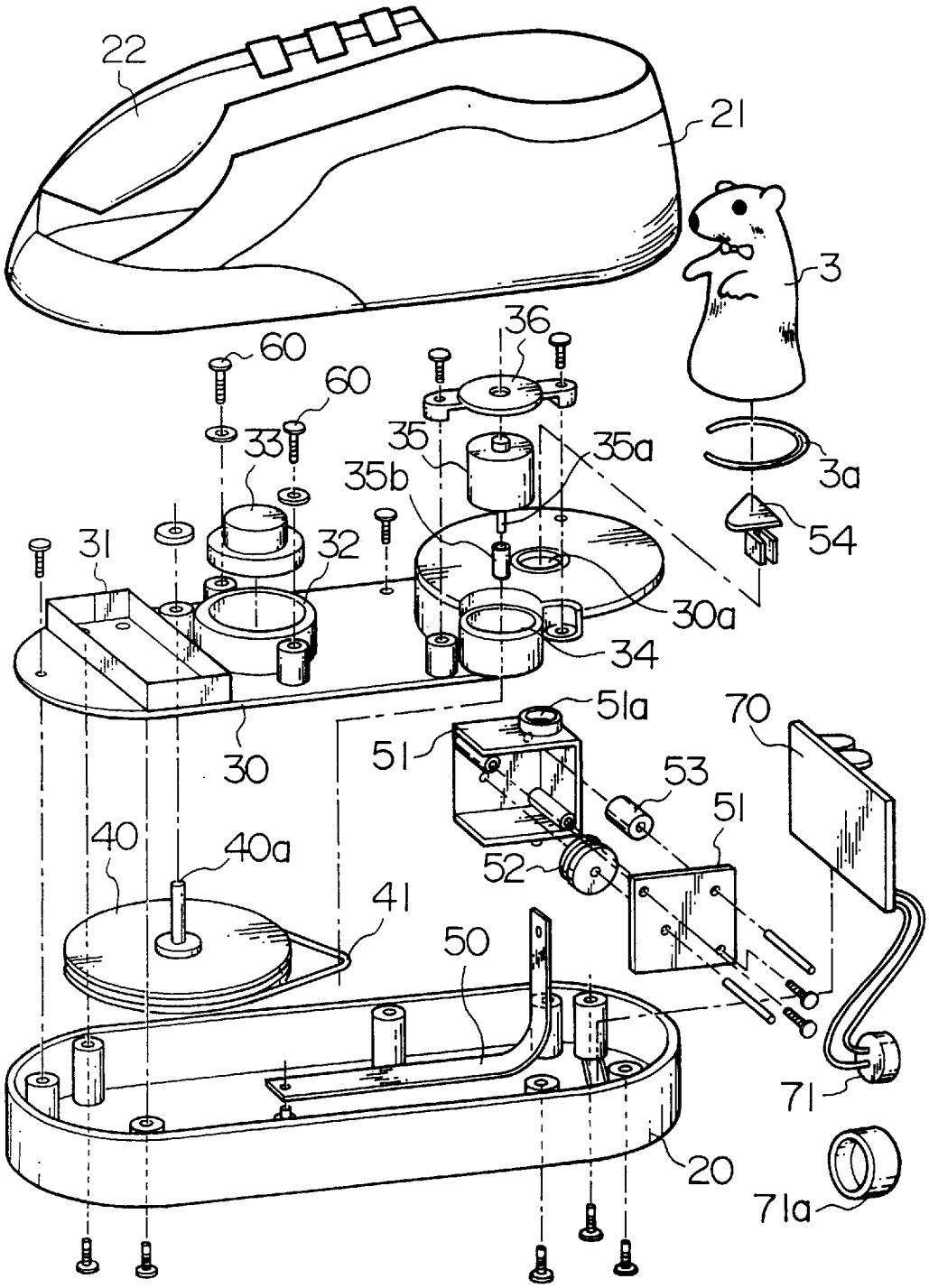
FIG. 2 is an exploded perspective view of the movable toy according to the embodiment.

The housing of the body 2 comprises a lower frame 20, an upper frame 21, and a battery cover 22, as shown in FIG. 2. The lower frame 20 forms the sole of a shoe, the upper frame 21 forms the side of the shoe, and the battery cover 22 forms the instep of the shoe.

Figure 5A:
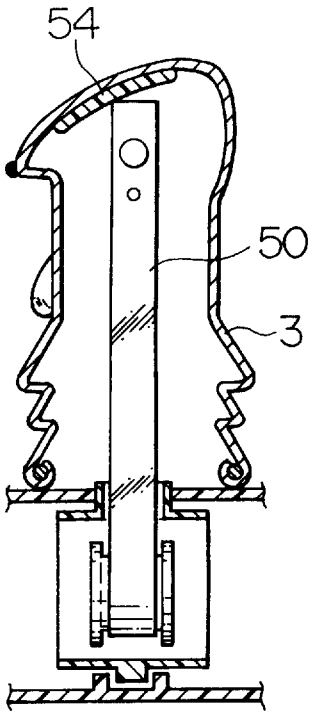
FIG. 5A is a vertical side elevational sectional view of the moving toy according to the embodiment.
Figure 5B:
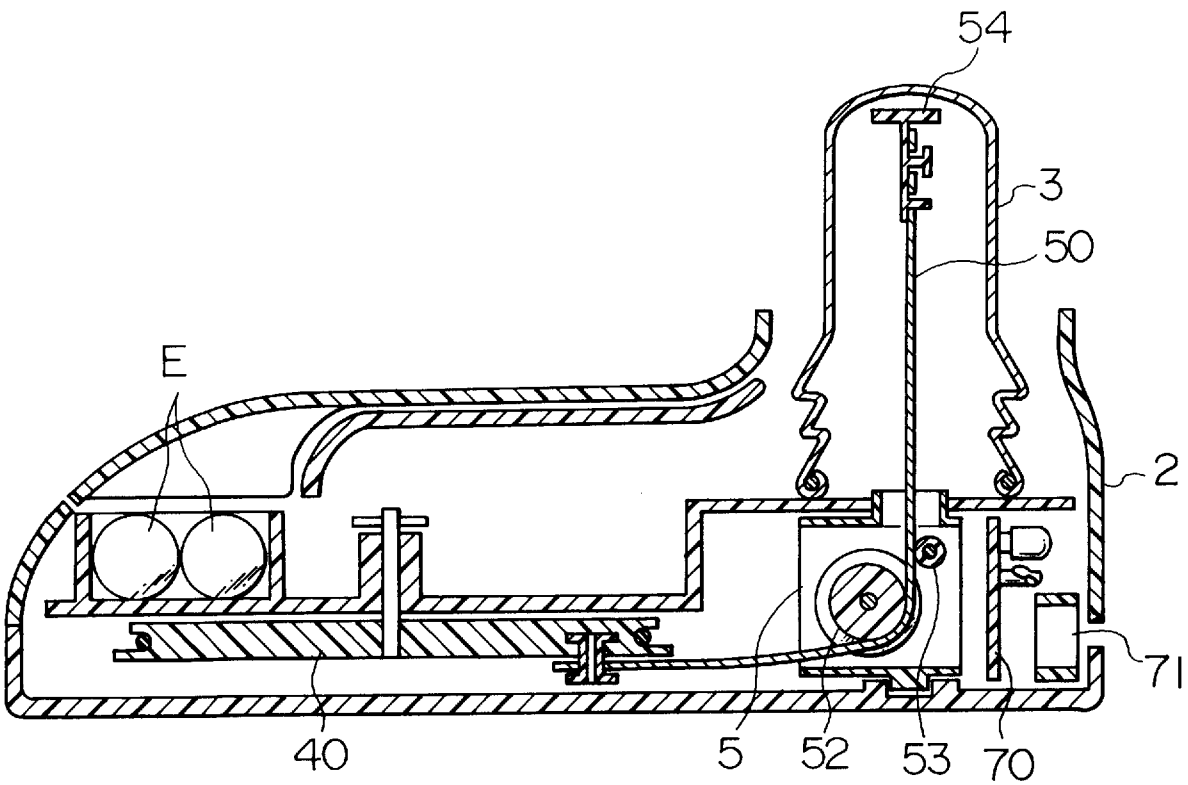
FIG. 5B is a vertical elevational sectional view of the moving toy according to the embodiment.

In the body 2, a mechanism frame 30 is provided. On the mechanism frame 30, a battery containing part 31 in which two cylindrical alkaline batteries E, e.g., of "AA" type (R6 or LR6 in Japanese Industrial Standard) each having a nominal voltage of 1.5 volt, can be contained, as shown in FIG. 5B, is attached. Adjacent to the battery containing part 31 on the mechanism frame 30, a speaker attachment part 32 is provided. A loud speaker 33 is attached to the speaker attachment part 32 so that the loud speaker 33 is pressed against the attachment part 32 by using screws 60 and washers. On the mechanism frame 30, a motor attachment part 34 is also provided and a motor 35 is attached to the motor attachment part 34. Attachment of the motor 35 is carried out by tightening screws to secure a motor supporting plate 36 to the mechanism frame 30. An axis 35*a* of the motor 35 penetrates the mechanism frame 30 and extends to a position below the mechanism frame 30.

A pulley (rotating member) 40 is provided below the mechanism frame 30. The pulley 40 is rotatable on an axis 40*a*. A rubber band 41 is wrapped in a peripheral groove of the pulley 40. A portion of the rubber band 41 is wrapped around a roller 35*b* made of brass which is attached to the lower top end of the axis 35*a* of the motor 35. The reason why the rubber band 41 is wrapped around the pulley 40 to transfer the power to the pulley 40 through the rubber band 41 is to prevent damage of the motor 35 by making the rubber band 41 slip to the pulley 40 when the movement of the animal doll 3 is stopped by a little child or the like grasping the animal doll 3 during operation of the motor 35, and to make the construction at a lower cost than that of a gear construction.

Figure 3:
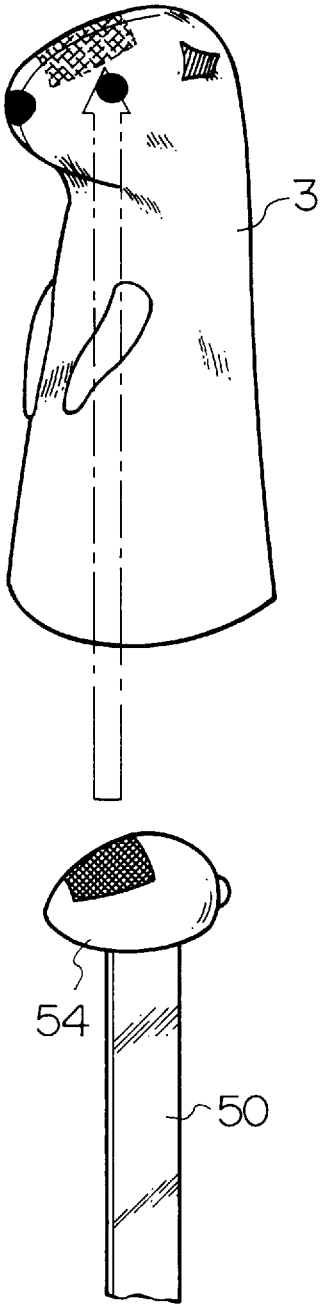
FIG. 3 is a perspective view for showing the relationship for engagement of a belt-like elastic body and an animal doll in the embodiment.

An end of a leaf spring 50, i.e., a band-shaped elastic member, made of steel, stainless steel or the like is connected to the pulley 40 at an eccentric position thereof. The leaf spring 50 is bent in a bow shape along the width direction. By bending the leaf spring 50 in such a bow shape, it is possible to easily restore the bent leaf spring to its original state, like a steel adding tape. As a result, according to this embodiment, it is possible to easily make the leaf spring 50 stand erect and to obtain a structure that resists being folded. The leaf spring 50 is guided by a pulley 52 which is provided on a swinging frame 51 and by a roller 53, and is drawn out of an upper opening 51*a* of the swinging frame 51 and an opening 30*a* of the mechanism frame 30 upwardly, as shown in FIGS. 5A and 5B. The upper end of the leaf spring 50 is engaged with the head portion of the animal doll 3. That is, the leaf spring 50 (elastic member) is bent in a smooth L-shape along the longitudinal direction, which comprises a horizontal portion connected to the pulley 40 (rotary member) and a vertical portion connected to the animal doll 3 (movable member). The upper end of the leaf spring 50 having a head portion molded part 54 attached thereto is inserted into the body of the animal doll 3 which is made of cloth and formed in a baggy shape, as shown in FIG. 3. The head portion molded part 54 and the inner surface of the body of the animal doll 3 are adhered to each other by using a Velcro, i.e., a fastener comprising a tape having a lot of loops attached on the surface thereof and the other tape having a lot of hooks which can engage with or disengage from the loops, attached on the surface thereof, or the like. The swinging frame 51 is for properly guiding the leaf spring 50 which swings also in a horizontal direction with rotation of the pulley 40.

In the body 2, a printed circuit board 70 having a control means mounted thereon is provided. A condenser microphone 71 is attached to the printed circuit board 70.

A control circuit provided on the printed circuit board 70 is shown in FIG. 4. The mode changing switch SW which is incorporated into the control circuit can take three positions "a", "b", and "c". When a moving contact 61 is connected to a point of contact "a", the control circuit gives the automatic mode to the moving toy 1; when the moving contact 61 is connected to another point of contact "b", the control circuit gives an off mode to the moving toy 1; and when the moving contact 61 is connected to another point of contact "c", the control circuit gives the sound sensing mode to the moving toy 1.

In a semiconductor integrated circuit 80 which comprises an LSI forming a main part of the control circuit, and the like, not only control data for controlling the direction and the time for the rotation of the motor 35 but also sound data corresponding to whining of a prairie dog or the like are stored.

When the automatic mode is selected, control data are read from the semiconductor integrated circuit 80, and signals based on the control data are output from an output port P1 or P2, so that the motor 35 is rotated in the normal direction or the reverse direction according to the output signal. A signal of high level is output from the output port P1 or P2 on the basis of the control data. That is, when a signal of high level is output from the output port P1, transistors Q1 and Q2 are operated to rotate the motor 35 in the normal direction, and when the signal of high level is output from the output port P2, transistors Q3 and Q4 are operated to rotate the motor 35 in the reverse direction. Simultaneously, sound data are also read out from the semiconductor integrated circuit 80, and a signal based on the sound data is output from the output port P3 to operate a transistor Q5, so that a sound similar to whining of a prairie dog or the like is generated through the loud speaker 33.

While the sound sensing mode is selected, control data are read from the semiconductor integrated circuit 80 only when the condenser microphone 71 senses a sound having a volume larger than a predetermined value, and a high level signal based on the control data is output from the output port P1 or P2, so that the motor 35 is rotated in the normal direction or the reverse direction according to the output signal. Simultaneously, sound data are also read out from the semiconductor integrated circuit 80, and a signal based on the sound data is output, so that a sound similar to whining of a prairie dog or the like is generated through the loud speaker 33.

In FIG. 2, reference numeral 3*a* denotes a weight ring which is attached to a lower portion of the animal doll 3, and reference numeral 71*a* denotes a microphone cover which is attached to the condenser microphone 71.

According to the moving toy of the embodiment having such a structure, it is possible to obtain advantageous effects, as follows.

It is possible to give a soft and smooth action similar to that of a real animal to the animal doll 3 because the animal doll 3 is supported and operated by the leaf spring 50 which smoothly converts a rotational movement of the pulley 40 into a linear movement, and to make the moving toy 1 at a lower cost.

According to the moving toy 1 of the embodiment, it is possible to provide a moving toy which gives a person added enjoyment because of the beauty and realism of the sound like a cry of the animal.

Further, according to the moving toy 1, it is possible to provide a very interesting moving toy which can exhibit the behavior of a real animal that is sensitive to an external sounds because the animal doll 3 is operated in response to the external sound.

Although the present invention has been explained according to the embodiment, it should also be understood that the present invention is not limited to the embodiment and that various changes and modifications may be made to the invention without departing from the gist thereof.

For example, although only an example using an animal doll 3 as a movable member with a shape has been explained in the above-described embodiment, of course, the movable member may be one having another shape, e.g., of an automobile, an airplane, a robot, or the like.

In the above-described embodiment, although only an example using a leaf spring 50 made of steel or stainless steel as a band-shaped elastic member, has been explained, of course, a band-shaped elastic member made of plastics may be also used.

According to the moving toy of the invention, it is possible to give a soft and smooth action to the movable member at a low cost because the movable member is supported and operated by the plate-shaped elastic member, which smoothly converts a rotational movement of the rotary member into a linear movement.

What is claimed is:

1. A moving toy comprising:

a body;

a movable member supported within the body and disposed adjacent an opening in the body; and a driving assembly coupled with the movable member, the driving assembly driving the movable member to protrude from and retreat into the body, the driving assembly including:

a motor, a rotary disk member coupled with the motor for rotation about an axis, the rotary disk member defining a rotary surface, a plate-shaped elastic member having a first end connected to the rotary surface of the rotary disk member at a position spaced radially from the axis and a second end connected to the movable member, a guide member coupled with the body and engaging the elastic member into a curved "L" shape and guiding the elastic member to flex along the curved "L" shape, and a control member communicating with the motor, the control member controlling the motor to control a position of the movable member.

2. A moving toy comprising:

a body having an opening;

a movable member protruding from and retreating into the body through the opening, a motor, a rotary member coupled to the motor to be rotated by the motor, a plate-shaped elastic member having a first end connected to the rotary member at an eccentric position thereof and a second end connected to the movable member, a guide member coupled with the body and engaging the elastic member between the rotary member and the movable member, the guide member bending the elastic member in a curved L-shape so that the elastic member has a parallel portion extending parallel to a surface of rotation of the rotary member, a bent portion at the guide member, and a perpendicular portion extending perpendicularly to the parallel portion the guide member further guiding portions of the elastic member between the parallel portion the bent portion, and the perpendicular portion, respectively, and a control member communicating with the motor, the control member controlling the motor to control a position of the movable member.

3. A moving toy as claimed in claim 2, wherein the movable member has a shape of an animal doll.

4. A moving toy as claimed in claim 3, further comprising a sound generating member for generating a sound like a cry of the animal.

5. A moving toy as claimed in claim 2, further comprising a sound sensing member communicating with the control member, the sound sensing member sensing an external sound and supplying a signal on the basis of the sensed external sound to the control member so as to rotate the motor.

6. A moving toy as claimed in claim 4, further comprising a sound sensing member communicating with the control member, the sound sensing member sensing an external sound and supplying a signal on the basis of the sensed external sound to the control member so as to rotate the motor and to operate the sound generating member.

7. A moving toy as claimed in claim 2, wherein the elastic member is bent in a bow shape along a width direction to ragidly restore the elastic member to a linear state as the portions of the elastic member pass the bent portion toward the parallel portion and the perpendicular portion respectively.

8. A moving toy as claimed in claim 2, wherein the elastic member is a leaf spring made of steel or stainless steel.

9. A moving toy as claimed in claim 2, wherein the movable member is controlled by the control member so that a movement thereof for protruding from or retreating into the body is irregular.

10. A moving toy as claimed in claim 8, wherein the amount of protrusion of the movable member from the body or the amount of retreat thereof, is controlled to be irregular.

11. A moving toy as claimed in claim 2, wherein the control member has a mode changing switch enabling selecting from one of an automatic mode in which the movable member is controlled to protrude from or to retreat into the inside of the body irregularly, an off mode in which the movable member is not operated, and a sound sensing mode in which the movable member is operated only when an external sound is sensed.

12. A moving toy as claimed in claim 2, wherein the movable member changes the direction thereof simultaneously with protruding from or retreating into the body.

13. A moving toy as claimed in claim 2, further comprising an elastic band coupled between the motor and the rotary member, wherein rotation of the motor is transferred to the rotary member through the elastic band which can slip to the rotary member when a large force is applied to the rotary member in a reverse direction.

14. A moving toy as claimed in claim 2, wherein the guide member comprises a pulley and a roller disposed in spaced relation, the elastic member extending between the pulley and the roller.

15. A moving toy as claimed in claim 2, wherein the guide member comprises a swinging frame preventing the perpendicular portion from swinging parallel to the surface of rotation of the rotary member.

* * * * *